US007353875B2

(12) United States Patent
Stephenson et al.

(10) Patent No.: US 7,353,875 B2
(45) Date of Patent: Apr. 8, 2008

(54) CENTRIFUGAL BLENDING SYSTEM

(75) Inventors: Stan Stephenson, Duncan, OK (US); Herbert Horinek, Duncan, OK (US); Max L. Phillippi, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 106 days.

(21) Appl. No.: 11/302,649

(22) Filed: Dec. 15, 2005

(65) Prior Publication Data

US 2007/0137862 A1 Jun. 21, 2007

(51) Int. Cl.
*E21B 43/267* (2006.01)

(52) U.S. Cl. ..... 166/305.1; 166/53; 166/75.15; 166/90.1

(58) Field of Classification Search ..... 166/305.1, 166/53, 75.15, 75.12, 90.1
See application file for complete search history.

(56) References Cited

U.S. PATENT DOCUMENTS 3,161,203 A 12/1964 Hathom et al.
4,159,180 A 6/1979 Cooper et al.
4,239,396 A 12/1980 Arribau et al.
4,453,829 A 6/1984 Althouse
4,460,276 A 7/1984 Arribau et al.
4,614,435 A 9/1986 McIntire
4,671,665 A 6/1987 McIntire
4,808,004 A 2/1989 McIntire et al.
4,845,981 A * 7/1989 Pearson ..... 73/152.31
4,850,702 A 7/1989 Arribau et al.
4,915,505 A 4/1990 Arribau et al.
4,930,576 A 6/1990 Berryman et al.
4,989,987 A 2/1991 Berryman et al.
5,026,168 A 6/1991 Berryman et al.
5,027,267 A * 6/1991 Pitts et al. ..... 700/67
5,289,877 A 3/1994 Naegele et al.

(Continued)

FOREIGN PATENT DOCUMENTS

WO WO 03/072328 9/2003

OTHER PUBLICATIONS

Foreign communication related to a counterpart application dated Mar. 8, 2007.

*Primary Examiner*—Kenneth Thompson
(74) *Attorney, Agent, or Firm*—John W. Wustenberg; Baker Botts L.L.P.

(57) ABSTRACT

The present invention relates generally to well servicing operations, and, more particularly, to devices, systems and methods useful in stimulation blending for fluids, mixtures, and/or slurries used in well servicing operations. A device, system and/or method is provided comprising a suction centrifugal pump capable of receiving an inlet fluid and providing a suction pressure arranged to substantially minimize a geyser effect in a proppant inlet and a mixer capable of receiving the inlet fluid provided by the suction centrifugal pump and mixing the inlet fluid with a proppant received from the proppant inlet, the mixer arranged to be substantially optimized for mixing. The device, system and/or method also comprises a discharge centrifugal pump capable of receiving the inlet fluid mixed with the proppant from the mixer and discharging the inlet fluid mixed with the proppant from the mixer downhole, the discharge centrifugal pump arranged to be substantially optimized for pumping. The system also comprises at least one downhole pump capable of receiving the inlet fluid mixed with the proppant from the mixer discharged downhole by the discharge centrifugal pump.

28 Claims, 6 Drawing Sheets

U.S. PATENT DOCUMENTS 5,320,425 A 6/1994 Stephenson et al.
5,365,435 A 11/1994 Stephenson et al.
6,007,227 A 12/1999 Carlson
6,167,965 B1 * 1/2001 Bearden et al. ..... 166/250.15
6,193,402 B1 2/2001 Grimland et al.
6,742,441 B1 6/2004 Surjaatmadja et al.
6,859,740 B2 2/2005 Stephenson et al.

* cited by examiner

CENTRIFUGAL BLENDING SYSTEM

BACKGROUND

The present invention relates generally to well servicing operations, and, more particularly, to devices, systems and methods useful in stimulation blending for fluids, mixtures, and/or slurries used in well servicing operations.

Figure 1A:
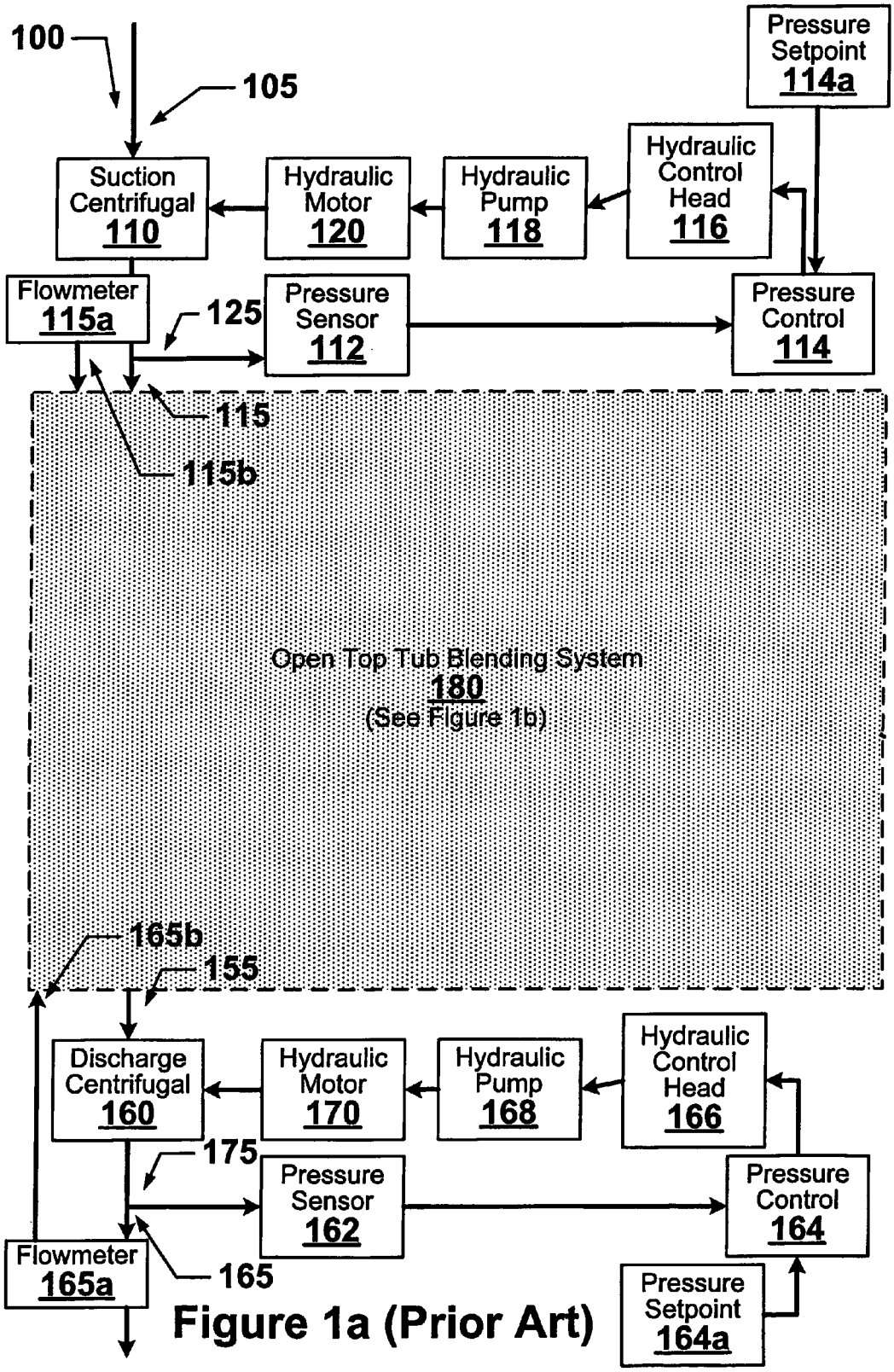
Figure 1a (Prior Art)
Figure 1B:
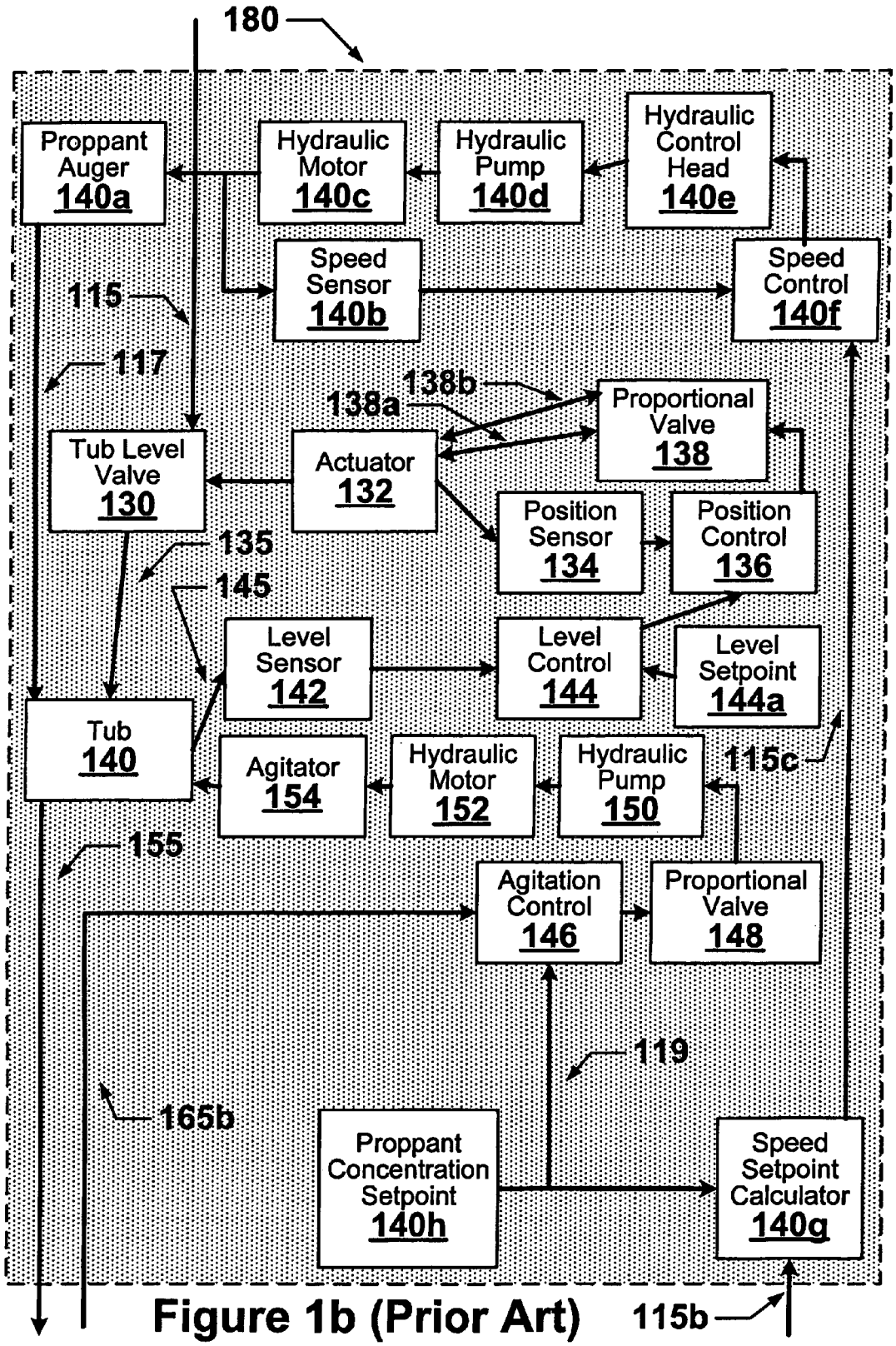
Figure 1b (Prior Art)
Figure 2:
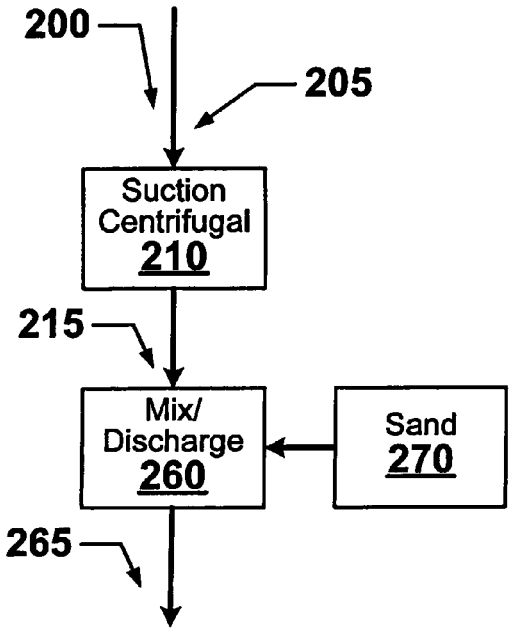
Figure 2 (Prior Art)
Figure 3:
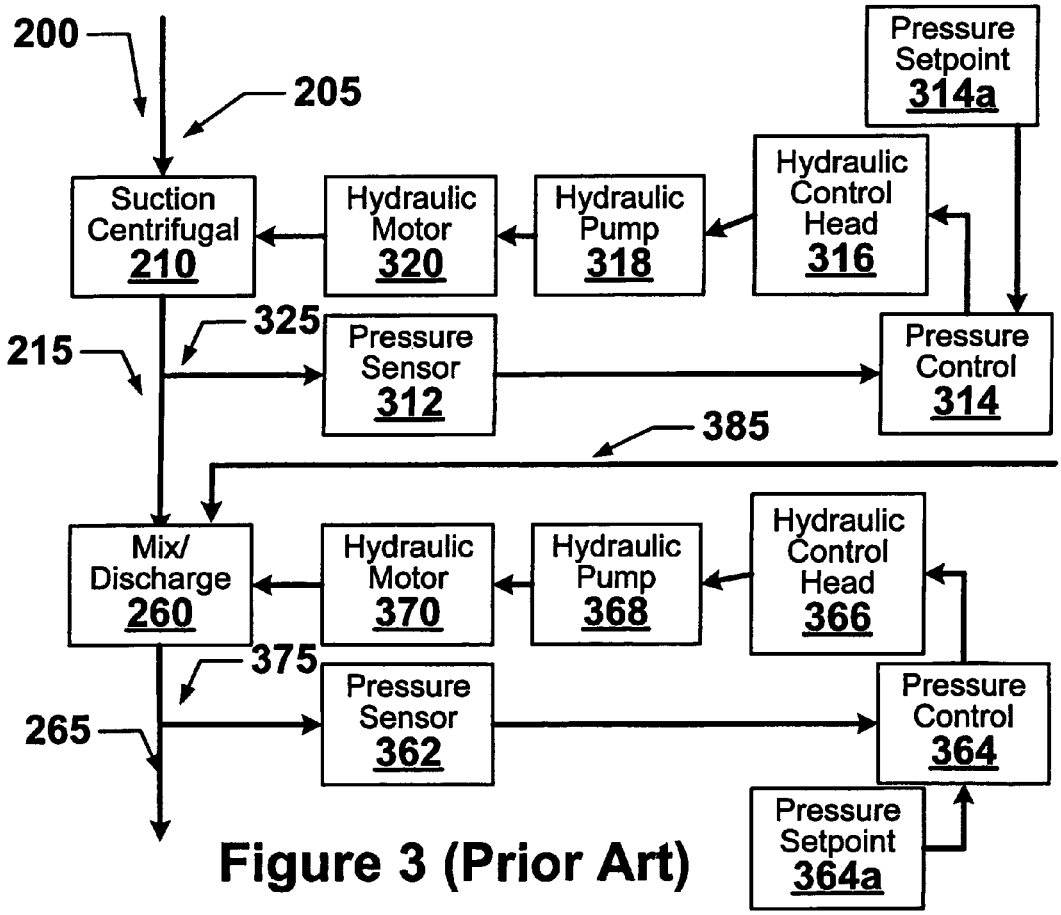
Figure 3 (Prior Art)

Conventional blenders have been either the open top tub blenders, as shown in FIG. 1, or the centrifugal blender, as shown in FIGS. 2 and 3, such as are used on the Crown blenders or the programmable optimum density (POD) blenders. FIGS. 1*a* and 1*b* schematically illustrates a conventional blender 100 with an open top blending tub system 180. Fluids are introduced through an inlet 105, drawn in by a suction centrifugal 110, and then sent through an outlet 115 to a tub level valve 130 of the open top blending tub system 180. FIG. 1*b* schematically illustrates the open top blending tub system 180 of the conventional blender 100 shown in FIG. 1*a*. A pressure sensor 112 attached to the outlet 115, as indicated at 125, senses the pressure present in the outlet 115. The pressure sensor 112 sends the sensed pressure information to a pressure controller 114. The pressure controller 114 compares the sensed pressure to a pressure setpoint, as indicated at 114*a*, and sends pressure error control information to an hydraulic control head 116. The hydraulic control head 116 sends hydraulic control information to an hydraulic pump 118. The hydraulic pump 118 sends hydraulic fluid to an hydraulic motor 120. The hydraulic motor 120 drives the suction centrifugal 110, based on the pressure sensed by the pressure sensor 112, as controlled by the pressure controller 114 and/or the hydraulic control head 116.

As shown in FIGS. 1*a* and 1*b*, the tub level valve 130 receives the inlet fluid from the outlet 115 of the suction centrifugal 110 and sends the fluid to an open top tub 140, as indicated at 135. A level sensor 142 senses the level of the fluid and/or fluid/proppant mixture in the open top tub 140. The level sensor 142 sends the sensed level information to a level controller 144. The level controller 144 compares the sensed level to a level setpoint, as indicated at 144*a*, and sends the level controller output as a position setpoint to a position controller 136. The position controller 136 compares the position setpoint with the position of an actuator 132 from a position sensor 134 and sends position control information to a proportional valve 138. If the position error is negative, the proportional valve 138 will divert hydraulic fluid through a line 138*a* to the actuator 132 that is connected to and rotates the tub level valve 130. This rotation will increase the opening of the tub level valve 130. If the position error is positive, the proportional valve 138 will divert hydraulic fluid through a line 138*b* to the actuator 132 that is connected to and rotates the tub level valve 130. This rotation will decrease the opening of the tub level valve 130.

Proppant is introduced into the tub 140 through a proppant auger 140*a*, as indicated at 117. The speed of the proppant auger 140*a* is sensed by a speed sensor 140*b*. The speed sensor 140*b* sends the sensed speed information to a speed controller 140*f*. The speed controller 140*f* compares the sensed speed to a speed setpoint from a speed setpoint calculator 140*g*. The speed setpoint calculator 140*g* receives flow information from a flowmeter 115*a* (FIG. 1*a*) and also information from a proppant concentration setpoint, as indicated at 140*h* to calculate the speed setpoint sent to the speed controller 140*f*, as indicated at 115*c*. The speed controller 140*f* calculates the error between the speed setpoint from the speed setpoint calculator 140*g* and the speed sensor 140*b*.

From the error, the speed controller 140*f* sends speed control information to an hydraulic control head 140*e*. The hydraulic control head 140*e* sends hydraulic control information to an hydraulic pump 140*d*. The hydraulic pump 140*d* sends hydraulic fluid to an hydraulic motor 140*c*. The hydraulic motor 140*c* drives the proppant auger 140*a* based on the speed calculated from speed setpoint calculator 140*g*.

An agitation controller 146 receives input information from the proppant setpoint, as indicated at 140*h* and 119, and a discharge flowmeter 165*a* (FIG. 1*a* and 1*b*), as indicated at 165*b*. The agitation controller 146 calculates the required agitation and sends speed control information to a proportional valve 148. The proportional valve 148 sends hydraulic control information to an hydraulic pump 150. The hydraulic pump 150 sends hydraulic fluid to an hydraulic motor 152. The hydraulic motor 152 drives an agitator 154. The agitator 154 agitates the open top tub 140, mixing the proppant introduced through the proppant auger 140*a* with the fluid flowing into the open top tub 140 through the tub level valve 130, as indicated at 135. The resulting blend of fluid and proppant flows out of the open top tub 140 through an outlet 155 into a discharge centrifugal pump 160 (FIGS. 1*a* and 1*b*). The resulting blend of fluid and proppant flows out of the discharge centrifugal pump 160 to the downhole pumps (not shown) through the discharge flowmeter 165*a* and an outlet 165.

A pressure sensor 162 senses the pressure present in the outlet 165, as indicated at 175. The pressure sensor 162 sends the sensed pressure information to a pressure controller 164. The pressure controller 164 compares the sensed pressure to a pressure setpoint, as indicated at 164*a*, and sends pressure error control information to an hydraulic control head 166. The hydraulic control head 166 sends hydraulic control information to an hydraulic pump 168. The hydraulic pump 168 sends hydraulic fluid to an hydraulic motor 170. The hydraulic motor 170 drives the discharge centrifugal pump 160, based on the pressure sensed by the pressure sensor 162, as controlled by the pressure controller 164.

The open top blending tub system 180 must have a very robust tub level system to prevent either overflowing the open top tub 140 or running the open top tub 140 dry during normal operation. At the same time, the tub level must maintain a relatively constant inlet flowrate as measured by the flowmeter 115*a* to keep a steady proppant concentration. The proppant rate is proportional to the inlet flowrate, as determined by the tub level valve 130. However, good tub level control and constant inlet flowrate are contradictory requirements. As such, constant inlet flowrate must be compromised to prevent either running the open top tub 140 dry or overflowing the open top tub 140.

Changes in tub level also cause changes in the time constant for the open top tub 140 that, in turn, cause the proppant concentration to vary. Unless the volumetric responses of both the tub level valve 130 and the proppant auger 140*a* are exactly the same, the inlet proppant concentration will always be changing whenever the inlet flowrate is changing. Variations in tub level also cause the suction pressure to change to the discharge centrifugal pump 160. If the suction pressure to the discharge centrifugal pump 160 is too low, the discharge centrifugal pump 160 will lose prime and the downhole pumps (not shown) will cavitate. Furthermore, if the agitation is too high in the open top tub 140, then too much air will be beat into the fluid, thereby causing a reduction in the boost pressure and possible loss of prime of the discharge centrifugal pump 160. However, too low an agitation rate causes erratic proppant concentrations due to proppant falling out of suspension. In addition to the variations in proppant concentration, unless the tub level valve 130 and the liquid and dry additives (not shown) have the same time response, there will also be variations in the liquid and dry additive concentrations due to the changes in inlet rate to the open top tub 140.

The inlet rate to the open top blending tub system 180 will also vary due to the changes in the pressure in the suction centrifugal 110 on the conventional blender 100. There are many different potential failure modes in the conventional blender 100 with the open top blending tub system 180 that are primarily due to problems in the open top blending tub system 180.

FIGS. 2 and 3 schematically illustrate a conventional blender 200 with a centrifugal mixing system 260. Fluids are introduced through an inlet 205, drawn in by a suction centrifugal 210, and then sent through an outlet 215 to a mix/discharge centrifugal system 260. The mix/discharge centrifugal system 260 receives proppant, such as sand, from a proppant supply 270, and mixes the proppant received from the proppant supply 270 with the fluids sent through the outlet 215 from the suction centrifugal 210.

As shown in more detail in FIG. 3, a pressure sensor 312 attached to the outlet 215, as indicated at 325, senses the pressure present in the outlet 215. The pressure sensor 312 sends the sensed pressure information to a pressure controller 314. The pressure controller 314 compares the sensed pressure to a pressure setpoint, as indicated at 314*a*, and sends pressure error control information to an hydraulic control head 316. The hydraulic control head 316 sends hydraulic control information to an hydraulic pump 318. The hydraulic pump 318 sends hydraulic fluid to an hydraulic motor 320. The hydraulic motor 320 drives the suction centrifugal 210, based on the pressure sensed by the pressure sensor 312, as controlled by the pressure controller 314 and/or the hydraulic control head 316.

Similarly, a pressure sensor 362 attached to the outlet 265, as indicated at 375, senses the pressure present in the outlet 265. The pressure sensor 362 sends the sensed pressure information to a pressure controller 364. The pressure controller 364 compares the sensed pressure to a pressure setpoint, as indicated at 364*a*, and sends pressure error control information to an hydraulic control head 366. The hydraulic control head 366 sends hydraulic control information to an hydraulic pump 368. The hydraulic pump 368 sends hydraulic fluid to an hydraulic motor 370. The hydraulic motor 370 drives the mix/discharge centrifugal system 260, based on the pressure sensed by the pressure sensor 362, as controlled by the pressure controller 364 and/or the hydraulic control head 366. The proppant may be introduced to the mix/discharge centrifugal system 260 through an inlet, as indicated at 385.

The conventional blender 200 with the mix/discharge centrifugal system 260 has at least four major problems. The first problem results when the mix/discharge centrifugal system 260 is shut down prior to the suction system. When this happens, the mix/discharge centrifugal system 260 no longer acts as a centrifugal check valve and the suction fluid can be blown out the proppant inlet 270 which may result in a major environmental spill. If oil-based fluids are being pumped, a potential fire hazard may also result. The second problem results from larger quantities of volatile vapors being emitted due to pressures potentially lower than atmospheric pressure at the proppant inlet 270 and/or 385.

The third problem results from using the same device, the mix/discharge centrifugal system 260, both to mix and to boost the downhole pumps (not shown). Suppose only 15 pounds per square inch (psi) were used for mixing as opposed to 60 psi for mixing and providing boost to the downhole pumps. According to the affinity laws for centrifugal pumps, well known to those skilled in the art, the impeller speed must be twice as fast at 60 psi as compared to 15 psi.

By the same affinity laws, the wear rate in the centrifugal would be a cubic function of the ratio of the impeller speeds. This means that the wear rate in the mix/discharge centrifugal system 260 operating at 60 psi would be 8 times as great as a mixer system operating at 15 psi, since the impeller speed at 60 psi is twice that at 15 psi and the wear rate is then $2_3$ =8 times as great. The fourth problem is the fact that this type of mix/discharge centrifugal system 260 consumes excessive horsepower, as described above with respect to the wear rate, and is, consequently, very inefficient. A good mixer is an inefficient pump and a good pump is an inefficient mixer. Since the same device, the mix/discharge centrifugal system 260, is used both to mix and to pump, overall efficiency is severely compromised.

U.S. Pat. No. 4,453,829 to Althouse, III, U.S. Pat. No. 4,614,435 to McIntire, and U.S. Pat. No. 4,671,665 to McIntire, show a conventional programmable optimum density (POD) mix/discharge centrifugal system that had problems due to also using this same programmable optimum density (POD) mix/discharge centrifugal system for a suction centrifugal. If any of the suction connections and/or hoses leaked air, then the suction side of this programmable optimum density (POD) mix/discharge centrifugal system would lose prime and the programmable optimum density (POD) mix/discharge centrifugal system would pack off with proppant and quit pumping.

U.S. Pat. No. 4,808,004 to McIntire et al., shows an improved conventional programmable optimum density (POD) mix/discharge centrifugal system that used a separate suction centrifugal pump to overcome the problems associated with using the same programmable optimum density (POD) mix/discharge centrifugal system for a suction centrifugal as well as for a mixing and a discharging centrifugal. The conventional blender 200 with the mix/discharge centrifugal system 260, as described above, similarly has a separate suction centrifugal 210.

U.S. Pat. No. 4,239,396 to Arribau et al., U.S. Pat. No. 4,460,276 to Arribau et al., U.S. Pat. No. 4,850,702 to Arribau et al., U.S. Pat. No. 4,915,505 to Arribau et al., and U.S. Pat. No. 6,193,402 to Grimland et al., show a similarly improved centrifugal mix/discharge system that used a separate suction centrifugal pump to overcome the problems associated with using the same mix/discharge centrifugal system for a suction centrifugal as well as for a mixing and a discharging centrifugal. In these systems, the discharge pressure is controlled by the suction pressure. These mix/discharge centrifugal systems provide a means for mixing the proppant and providing at least 5 psi boost above the suction pressure, so that there is a compromise between being an efficient pump and an efficient mixer. If the mix/discharge centrifugal system is shut down and/or goes down due to a failure prior to shutting down the suction centrifugal pump, then a geyser of fluid is sent out the proppant inlet of the mix/discharge centrifugal system.

The mix/discharge centrifugal system described in U.S. Pat. No. 4,915,505 to Arribau et al. attempted to overcome the geyser problem by connecting the suction pump and the mix/discharge centrifugal system to a common driveline. However, such a design brings back the problems associated with the conventional programmable optimum density (POD) mix/discharge centrifugal systems described in U.S.

Pat. No. 4,453,829 to Althouse, III, U.S. Pat. No. 4,614,435 to McIntire, and U.S. Pat. No. 4,671,665 to McIntire, where, if any of the suction connections and/or hoses leaked air, then the suction side of such a programmable optimum density (POD) mix/discharge centrifugal system would lose prime and the programmable optimum density (POD) mix/discharge centrifugal system would pack off with proppant and quit pumping.

SUMMARY

The present invention relates generally to well servicing operations, and, more particularly, to devices, systems and methods useful in stimulation blending for fluids, mixtures, and/or slurries used in well servicing operations.

A device and/or system useful in stimulation blending for fluids, mixtures, and/or slurries used in well servicing operations is provided, the device and/or system comprising a suction centrifugal pump capable of receiving an inlet fluid and providing a suction pressure arranged to substantially minimize a geyser effect in a proppant inlet and a mixer capable of receiving the inlet fluid provided by the suction centrifugal pump and mixing the inlet fluid with a proppant received from the proppant inlet, the mixer arranged to be substantially optimized for mixing. The device and/or system also comprises a discharge centrifugal pump capable of receiving the inlet fluid mixed with the proppant from the mixer and discharging the inlet fluid mixed with the proppant from the mixer downhole, the discharge centrifugal pump arranged to be substantially optimized for pumping. The system also comprises at least one downhole pump capable of receiving the inlet fluid mixed with the proppant from the mixer discharged downhole by the discharge centrifugal pump.

A method useful in stimulation blending for fluids, mixtures, and/or slurries used in well servicing operations is provided, the method comprising providing a suction pressure arranged to substantially minimize a geyser effect in a proppant inlet using a suction centrifugal pump receiving an inlet fluid. The method also comprises receiving the inlet fluid provided by the suction centrifugal pump and mixing the inlet fluid with a proppant received from the proppant inlet using a mixer arranged to be substantially optimized for mixing. The method also comprises receiving the inlet fluid mixed with the proppant from the mixer and discharging the inlet fluid mixed with the proppant from the mixer downhole using a discharge centrifugal pump arranged to be substantially optimized for pumping.

In one aspect, the device and/or system useful in stimulation blending for fluids, mixtures, and/or slurries used in well servicing operations further comprises a speed sensor capable of sensing an impeller speed of the mixer, a pressure sensor capable of sensing the pressure exiting the mixer, a speed/pressure controller capable of receiving the impeller speed information sensed by the speed sensor and the mixer pressure information sensed by the pressure sensor, a mixer hydraulic control head capable of being controlled by the speed/pressure controller, a mixer hydraulic pump capable of being controlled by the hydraulic control head, and a mixer hydraulic motor capable of cooperating with the mixer hydraulic pump to drive at least one impeller of the mixer. In another aspect, the device and/or system further comprises a suction pressure sensor capable of sensing the suction pressure of the inlet fluid provided by the suction centrifugal pump, a suction pressure controller capable of receiving the suction pressure information sensed by the suction pressure sensor, a suction hydraulic control head capable of being controlled by the suction pressure controller, a suction hydraulic pump capable of being controlled by the suction hydraulic control head, and a suction hydraulic motor capable of cooperating with the suction hydraulic pump to drive at least one impeller of the suction centrifugal pump.

In yet another aspect, the device and/or system further comprises a discharge pressure sensor capable of sensing a discharge pressure of the inlet fluid mixed with the proppant from the mixer provided by the discharge centrifugal pump, a discharge pressure controller capable of receiving the discharge pressure information sensed by the discharge pressure sensor, a discharge hydraulic control head capable of being controlled by the discharge pressure controller, a discharge hydraulic pump capable of being controlled by the discharge hydraulic control head, and a discharge hydraulic motor capable of cooperating with the discharge hydraulic pump to drive at least one impeller of the discharge centrifugal pump. In still another aspect, the device and/or system further comprises a suction centrifugal pump capable of providing the suction pressure in a range of from about 1 pound per square inch (psi) to about 5 pounds per square inch (psi). In still yet another aspect, the device and/or system further comprises a mixer capable of providing an additional pressure in a range of about 1 pound per square inch (psi) to about 10 pounds per square inch (psi) above the suction pressure provided by the suction centrifugal pump.

In yet another aspect, the device and/or system further comprises a mixer arranged to substantially minimize a wear rate in the mixer. In still another aspect, the device and/or system further comprises a mixer arranged to substantially minimize vapor released from volatile liquids due to lower differential pressures. In still yet another aspect, the device and/or system further comprises a mixer arranged to substantially minimize power required due to being substantially optimized for mixing.

In still yet another further aspect, the device and/or system useful in stimulation blending for fluids, mixtures, and/or slurries used in well servicing operations further comprises a speed sensor capable of sensing an impeller speed of the mixer, a pressure sensor capable of sensing the pressure exiting the mixer, a speed/pressure controller capable of receiving the impeller speed information sensed by the speed sensor and the mixer exit pressure sensed by the pressure sensor, a mixer hydraulic control head capable of being controlled by the speed/pressure controller, a mixer hydraulic pump capable of being controlled by the hydraulic control head, and a mixer hydraulic motor capable of cooperating with the mixer hydraulic pump to drive at least one impeller of the mixer. In this still yet another further aspect, the device and/or system also further comprises a suction pressure sensor capable of sensing the suction pressure of the inlet fluid provided by the suction centrifugal pump, a suction pressure controller capable of receiving the suction pressure information sensed by the suction pressure sensor, a suction hydraulic control head capable of being controlled by the suction pressure controller, a suction hydraulic pump capable of being controlled by the suction hydraulic control head, and a suction hydraulic motor capable of cooperating with the suction hydraulic pump to drive at least one impeller of the suction centrifugal pump. In this still yet another further aspect, the device and/or system also further comprises a discharge pressure sensor capable of sensing a discharge pressure of the inlet fluid mixed with the proppant from the mixer provided by the discharge centrifugal pump, a discharge pressure controller capable of receiving the discharge pressure information sensed by the discharge pressure sensor, a discharge hydraulic control head capable of being controlled by the discharge pressure controller, a discharge hydraulic pump capable of being controlled by the discharge hydraulic control head, and a discharge hydraulic motor capable of cooperating with the discharge hydraulic pump to drive at least one impeller of the discharge centrifugal pump.

In one aspect, the method useful in stimulation blending for fluids, mixtures, and/or slurries used in well servicing operations further comprises sensing an impeller speed of the mixer using a speed sensor, sensing a mixer exit pressure using a pressure sensor, receiving the impeller speed information sensed by the speed sensor and the mixer exit pressure information sensed by the pressure sensor using a speed/pressure controller, controlling a mixer hydraulic control head using the speed controller, controlling a mixer hydraulic pump using the hydraulic control head, and driving at least one impeller of the mixer using a mixer hydraulic motor cooperating with the mixer hydraulic pump. In another aspect, the method further comprises sensing the suction pressure of the inlet fluid provided by the suction centrifugal pump using a suction pressure sensor, receiving the suction pressure information sensed by the suction pressure sensor using a suction pressure controller, controlling a suction hydraulic control head using the suction pressure controller, controlling a suction hydraulic pump using the suction hydraulic control head, and driving at least one impeller of the suction centrifugal pump using a suction hydraulic motor cooperating with the suction hydraulic pump.

In yet another aspect, the method further comprises sensing a discharge pressure of the inlet fluid mixed with the proppant from the mixer provided by the discharge centrifugal pump using a discharge pressure sensor, receiving the discharge pressure information sensed by the discharge pressure sensor using a discharge pressure controller, controlling a discharge hydraulic control head using the discharge pressure controller, controlling a discharge hydraulic pump using the discharge hydraulic control head, and driving at least one impeller of the discharge centrifugal pump using a discharge hydraulic motor cooperating with the discharge hydraulic pump. In still another aspect, the method further comprises providing the suction pressure in a range of from about 1 pound per square inch (psi) to about 5 pounds per square inch (psi). In still yet another aspect, the method further comprises using the mixer to provide an additional pressure in a range of about 1 pound per square inch (psi) to about 10 pounds per square inch (psi) above the suction pressure provided by the suction centrifugal pump.

In yet another aspect, the method further comprises using a mixer arranged to substantially minimize a wear rate in the mixer. In still another aspect, the method further comprises using a mixer arranged to substantially minimize vapor released from volatile liquids due to lower differential pressures. In still yet another aspect, the method further comprises using a mixer arranged to substantially minimize power required due to being substantially optimized for mixing.

In still yet another further aspect, the method useful in stimulation blending for fluids, mixtures, and/or slurries used in well servicing operations further comprises sensing an impeller speed of the mixer using a speed sensor, sensing the mixer exit pressure using a pressure sensor, receiving the impeller speed information sensed by the speed sensor and receiving the mixer exit pressure information sensed by the pressure sensor using a speed/pressure controller, controlling a mixer hydraulic control head using the speed controller, controlling a mixer hydraulic pump using the hydraulic control head, and driving at least one impeller of the mixer using a mixer hydraulic motor cooperating with the mixer hydraulic pump. In this still yet another further aspect, the method also further comprises sensing the suction pressure of the inlet fluid provided by the suction centrifugal pump using a suction pressure sensor, receiving the suction pressure information sensed by the suction pressure sensor using a suction pressure controller, controlling a suction hydraulic control head using the suction pressure controller, controlling a suction hydraulic pump using the suction hydraulic control head, and driving at least one impeller of the suction centrifugal pump using a suction hydraulic motor cooperating with the suction hydraulic pump. In this still yet another further aspect, the method also further comprises sensing a discharge pressure of the inlet fluid mixed with the proppant from the mixer provided by the discharge centrifugal pump using a discharge pressure sensor, receiving the discharge pressure information sensed by the discharge pressure sensor using a discharge pressure controller, controlling a discharge hydraulic control head using the discharge pressure controller, controlling a discharge hydraulic pump using the discharge hydraulic control head, and driving at least one impeller of the discharge centrifugal pump using a discharge hydraulic motor cooperating with the discharge hydraulic pump.

The features and advantages of the present invention will be readily apparent to those skilled in the art upon a reading of the present disclosure, including the descriptions of the various illustrative embodiments that follow.

DRAWINGS

The following figures form part of the present specification and are included to further demonstrate certain aspects of the present invention. The present invention may be better understood by reference to one or more of these drawings in combination with the description of embodiments presented herein.

Consequently, a more complete understanding of the present disclosure and advantages thereof may be acquired by referring to the following description taken in conjunction with the accompanying drawings, in which the leftmost significant digit(s) in the reference numerals denote(s) the first figure in which the respective reference numerals appear, wherein:

FIG. 1*a* schematically illustrates a conventional blender with an open top blending tub system;

FIG. 1*b* schematically illustrates the open top blending tub system of the conventional blender shown in FIG. 1*a;*

Figure 4:
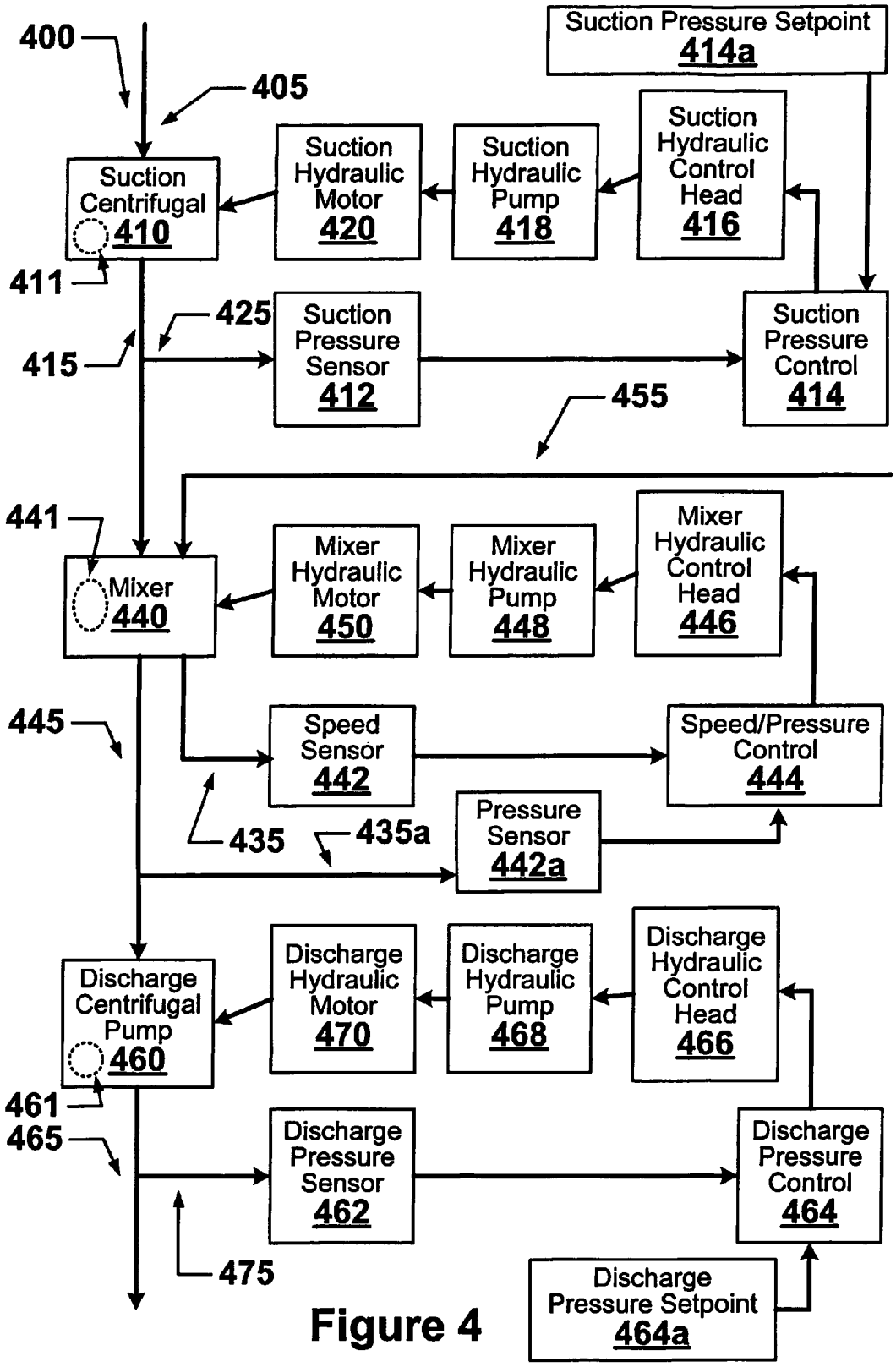
Figure 5:
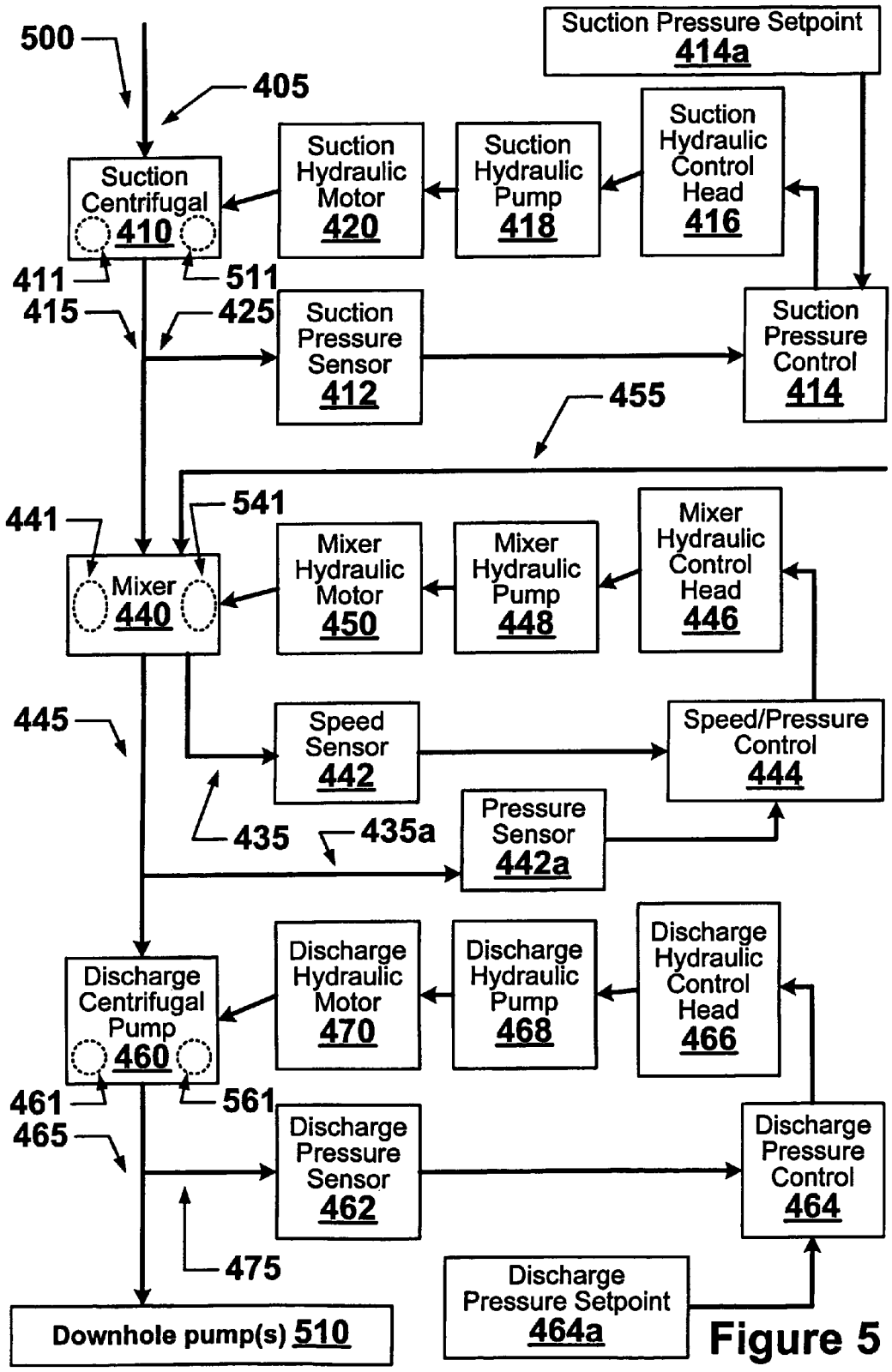
Figure 6:
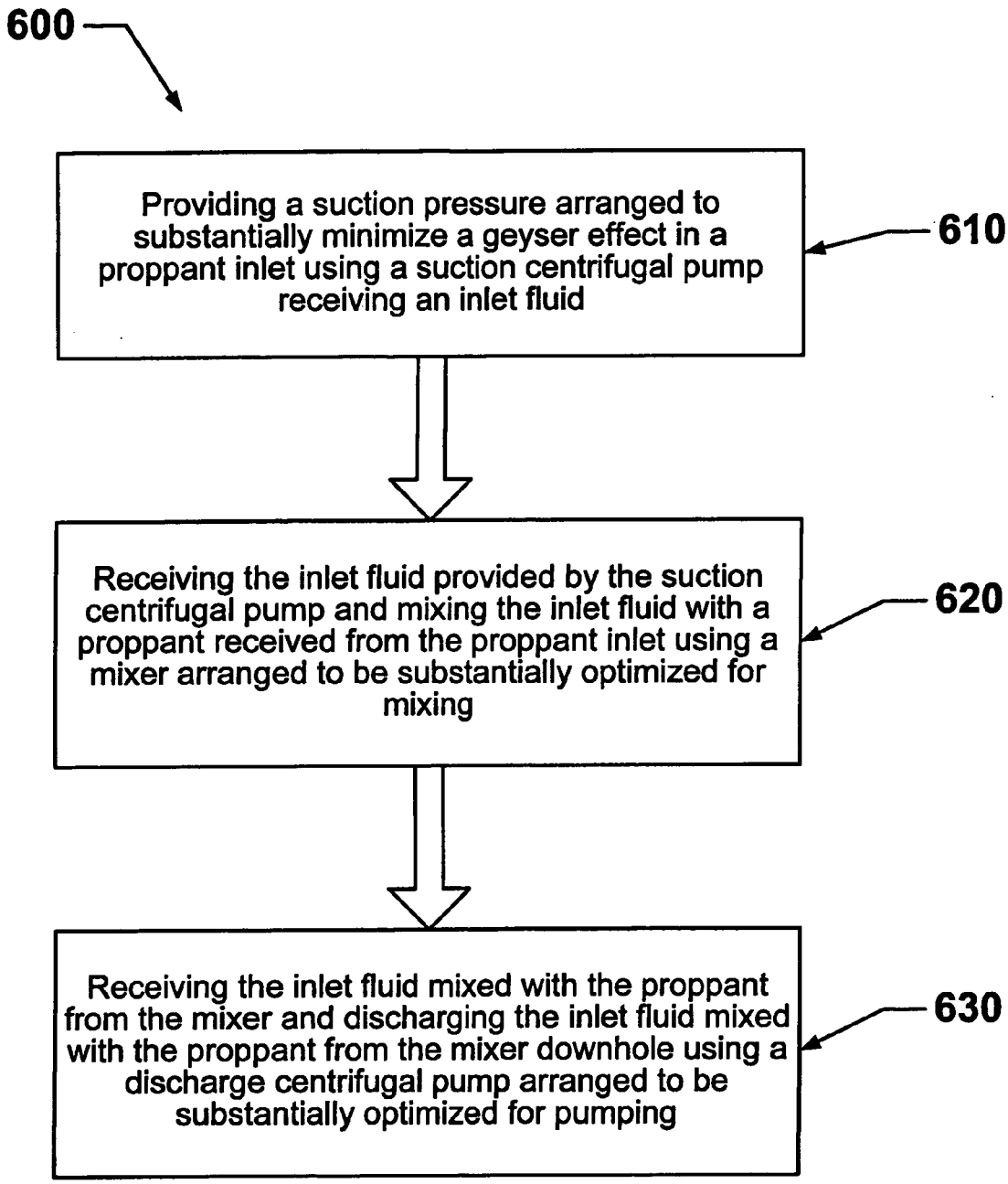

FIG. 2 schematically illustrates a conventional blender with a centrifugal mixing system;

FIG. 3 schematically illustrates a more detailed view of the conventional blender with the centrifugal mixing system shown in FIG. 2;

FIG. 4 schematically illustrates a device useful in stimulation blending for fluids, mixtures, and/or slurries used in well servicing operations according to various exemplary embodiments;

FIG. 5 schematically illustrates a system useful in stimulation blending for fluids, mixtures, and/or slurries used in well servicing operations according to various exemplary embodiments; and FIG. 6 schematically illustrates a method useful in stimulation blending for fluids, mixtures, and/or slurries used in well servicing operations according to various exemplary embodiments.

It is to be noted, however, that the appended drawings illustrate only typical embodiments of the present invention and are, therefore, not to be considered limiting of the scope of the present invention, as the present invention may admit to other equally effective embodiments.

DESCRIPTION

The present invention relates generally to well servicing operations, and, more particularly, to devices, systems and methods useful in stimulation blending for fluids, mixtures, and/or slurries used in well servicing operations.

Illustrative embodiments of the present invention are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

In various illustrative embodiments, as shown, for example, in FIGS. 4 and 5, a device 400 and a system 500 useful in stimulation blending for fluids, mixtures, and/or slurries used in well servicing operations may comprise a suction centrifugal pump 410 capable of receiving an inlet fluid, as indicated at 405, and providing a suction pressure arranged to substantially minimize a geyser effect in a proppant inlet, as indicated at 455, and a mixer 440 capable of receiving the inlet fluid, as indicated at 415, provided by the suction centrifugal pump 410 and mixing the inlet fluid 415 with a proppant received from the proppant inlet 455, the mixer 440 arranged to be substantially optimized for mixing. The device 400 and/or system 500 may also comprise a discharge centrifugal pump 460 capable of receiving the inlet fluid mixed with the proppant, as indicated at 445, from the mixer 440 and discharging the inlet fluid mixed with the proppant from the mixer 440 downhole, as indicated at 465, the discharge centrifugal pump 460 arranged to be substantially optimized for pumping. The system 500 also comprises at least one downhole pump 510 capable of receiving the inlet fluid mixed with the proppant from the mixer discharged downhole by the discharge centrifugal pump 460, as indicated at 465.

In various illustrative embodiments, the device 400 and/or system 500 useful in stimulation blending for fluids, mixtures, and/or slurries used in well servicing operations may further comprise a speed sensor 442 capable of sensing an impeller speed of the mixer 440, as indicated at 435, a pressure sensor 442*a* capable of sensing the exit pressure of mixer 440, as indicated at 435*a*, a speed/pressure controller 444 capable of receiving the impeller speed information sensed by the speed sensor 442 and the mixer exit pressure sensed by pressure sensor 442*a*, a mixer hydraulic control head 446 capable of being controlled by the speed/pressure controller 444, a mixer hydraulic pump 448 capable of being controlled by the hydraulic control head 446, and a mixer hydraulic motor 450 capable of cooperating with the mixer hydraulic pump 448 to drive at least one impeller 441 (shown in phantom) of the mixer 440. In various illustrative embodiments, as shown in FIG. 5, for example, the mixer 440 may have a plurality of impellers 441, 541 (shown in phantom).

In various illustrative embodiments, the device 400 and/or system 500 useful in stimulation blending for fluids, mixtures, and/or slurries used in well servicing operations may further comprise a suction pressure sensor 412 capable of sensing the suction pressure of the inlet fluid 415 provided by the suction centrifugal pump 410, as indicated at 425, a suction pressure controller 414 capable of receiving the suction pressure information sensed by the suction pressure sensor 412, comparing the sensed suction pressure to a suction pressure setpoint, as indicated at 414*a*, and sending suction pressure error control information to a suction hydraulic control head 416 capable of being controlled by the suction pressure controller 414, a suction hydraulic pump 418 capable of being controlled by the suction hydraulic control head 416, and a suction hydraulic motor 420 capable of cooperating with the suction hydraulic pump 418 to drive at least one impeller 411 (shown in phantom) of the suction centrifugal pump 410. In various illustrative embodiments, as shown in FIG. 5, for example, the suction centrifugal pump 410 may have a plurality of impellers 411, 511 (shown in phantom).

In various illustrative embodiments, the device 400 and/or system 500 useful in stimulation blending for fluids, mixtures, and/or slurries used in well servicing operations may further comprise a discharge pressure sensor 462 capable of sensing a discharge pressure of the inlet fluid mixed with the proppant 465 from the mixer 440 provided by the discharge centrifugal pump 460, as indicated at 475, a discharge pressure controller 464 capable of receiving the discharge pressure information sensed by the discharge pressure sensor 462, comparing the sensed discharge pressure to a discharge pressure setpoint, as indicated at 464*a*, and sending discharge pressure error control information to a discharge hydraulic control head 466 capable of being controlled by the discharge pressure controller 464, a discharge hydraulic pump 468 capable of being controlled by the discharge hydraulic control head 466, and a discharge hydraulic motor 470 capable of cooperating with the discharge hydraulic pump 468 to drive at least one impeller 461 (shown in phantom) of the discharge centrifugal pump 460. In various illustrative embodiments, as shown in FIG. 5, for example, the discharge centrifugal pump 460 may have a plurality of impellers 461, 561 (shown in phantom).

In various illustrative embodiments, the device 400 and/or system 500 useful in stimulation blending for fluids, mixtures, and/or slurries used in well servicing operations may further comprise a suction centrifugal pump 410 capable of providing the suction pressure in a range of from about 1 pound per square inch (psi) to about 5 pounds per square inch (psi). In various exemplary illustrative embodiments, the device 400 and/or system 500 may further comprise the suction centrifugal pump 410 capable of providing the suction pressure in a range of from about 5 pounds per square inch (psi) to about 10 pounds per square inch (psi).

In various illustrative embodiments, the device 400 and/or system 500 useful in stimulation blending for fluids, mixtures, and/or slurries used in well servicing operations may further comprise a mixer 440 capable of providing an additional pressure in a range of about 1 pound per square inch (psi) to about 10 pounds per square inch (psi) above the suction pressure provided by the suction centrifugal pump 410. In various exemplary illustrative embodiments, the device 400 and/or system 500 may further comprise the mixer 440 capable of providing an additional pressure of about 5 pounds per square inch (psi) above the suction pressure provided by the suction centrifugal pump 410.

In various illustrative embodiments, the device 400 and/or system 500 may further comprise a mixer 440 arranged to substantially minimize a wear rate in the mixer 440. In various illustrative embodiments, the device 400 and/or system 500 may further comprise a mixer 440 arranged to substantially minimize vapor released from volatile liquids due to lower differential pressures. In various illustrative embodiments, the device 400 and/or system 500 may further comprise a mixer 440 arranged to substantially minimize power required due to being substantially optimized for mixing.

In various illustrative embodiments, the device 400 and/or system 500 useful in stimulation blending for fluids, mixtures, and/or slurries used in well servicing operations may further comprise the speed sensor 442 capable of sensing the impeller speed of the mixer 440, as indicated at 435, a pressure sensor 442*a* capable of sensing the exit pressure of mixer 440, as indicated at 435*a*, the speed/pressure controller 444 capable of receiving the impeller speed information sensed by the speed sensor 442 and the mixer exit pressure sensed by pressure sensor 442*a*, the mixer hydraulic control head 446 capable of being controlled by the speed/pressure controller 444, the mixer hydraulic pump 448 capable of being controlled by the hydraulic control head 446, and the mixer hydraulic motor 450 capable of cooperating with the mixer hydraulic pump 448 to drive at least one impeller 441 (shown in phantom) of the mixer 440. In these various illustrative embodiments, the device 400 and/or system 500 may further comprise the suction pressure sensor 412 capable of sensing the suction pressure of the inlet fluid 415 provided by the suction centrifugal pump 410, as indicated at 425, the suction pressure controller 414 capable of receiving the suction pressure information sensed by the suction pressure sensor 412, comparing the sensed suction pressure to a suction pressure setpoint, as indicated at 414*a*, and sending suction pressure error control information to the suction hydraulic control head 416 capable of being controlled by the suction pressure controller 414, the suction hydraulic pump 418 capable of being controlled by the suction hydraulic control head 416, and the suction hydraulic motor 420 capable of cooperating with the suction hydraulic pump 418 to drive at least one impeller 411 (shown in phantom) of the suction centrifugal pump 410. In these various illustrative embodiments, the device 400 and/or system 500 may further comprise the discharge pressure sensor462 capable of sensing the discharge pressure of the inlet fluid mixed with the proppant 465 from the mixer 440 provided by the discharge centrifugal pump 460, as indicated at 475, the discharge pressure controller 464 capable of receiving the discharge pressure information sensed by the discharge pressure sensor 462, comparing the sensed discharge pressure to a discharge pressure setpoint, as indicated at 464*a*, and sending discharge pressure error control information to the discharge hydraulic control head 466 capable of being controlled by the discharge pressure controller 464, the discharge hydraulic pump 468 capable of being controlled by the discharge hydraulic control head 466, and the discharge hydraulic motor 470 capable of cooperating with the discharge hydraulic pump 468 to drive at least one impeller 461 (shown in phantom) of the discharge centrifugal pump 460.

In various illustrative embodiments, as shown in FIG. 6, a method 600 useful in stimulation blending for fluids, mixtures, and/or slurries used in well servicing operations may be provided. The method 600 may comprise providing a suction pressure arranged to substantially minimize a geyser effect in a proppant inlet using a suction centrifugal pump receiving an inlet fluid, as indicated at 610. The method 600 may also comprise receiving the inlet fluid provided by the suction centrifugal pump and mixing the inlet fluid with a proppant received from the proppant inlet using a mixer arranged to be substantially optimized for mixing, as indicated at 620. The method 600 may also comprise receiving the inlet fluid mixed with the proppant from the mixer and discharging the inlet fluid mixed with the proppant from the mixer downhole using a discharge centrifugal pump arranged to be substantially optimized for pumping, as indicated at 630.

For example, in various illustrative embodiments, the method 600 useful in stimulation blending for fluids, mixtures, and/or slurries used in well servicing operations may comprise, as indicated 610, providing the suction pressure arranged to substantially minimize the geyser effect in the proppant inlet 455 using the suction centrifugal pump 410 receiving the inlet fluid, as indicated 405. In various illustrative embodiments, the method 600 may also comprise, as indicated 620, receiving the inlet fluid provided by the suction centrifugal pump, as indicated 415, and mixing the inlet fluid 415 with the proppant received from the proppant inlet 455 using the mixer 440 arranged to be substantially optimized for mixing. In various illustrative embodiments, the method 600 may also comprise, as indicated 630, receiving the inlet fluid mixed with the proppant from the mixer 440, as indicated 445, and discharging the inlet fluid mixed with the proppant 445 from the mixer 440 downhole using the discharge centrifugal pump 460 arranged to be substantially optimized for pumping.

In various illustrative embodiments, the method 600 useful in stimulation blending for fluids, mixtures, and/or slurries used in well servicing operations may further comprise sensing the impeller speed of the mixer 440 using the speed sensor 442, as indicated at 435, sensing the exit pressure of the mixer 440 using the pressure sensor 442*a*, as indicated at 435*a*, receiving the impeller speed information sensed by the speed sensor 442 and the mixer exit pressure sensed by pressure sensor 442*a* using the speed/pressure controller 444, controlling the mixer hydraulic control head 446 using the speed/pressure controller 444, controlling the mixer hydraulic pump 448 using the hydraulic control head 446, and driving at least one impeller 441 (shown in phantom) of the mixer 440 using the mixer hydraulic motor 450 cooperating with the mixer hydraulic pump 448. In various illustrative embodiments, as shown in FIG. 5, for example, the mixer 440 may have a plurality of impellers 441, 541 (shown in phantom).

In various illustrative embodiments, the method 600 may further comprise sensing the suction pressure of the inlet fluid 415 provided by the suction centrifugal pump 410 using the suction pressure sensor 412, as indicated at 425, receiving the suction pressure information sensed by the suction pressure sensor 412 using the suction pressure controller 414, controlling the suction hydraulic control head 416 using the suction pressure controller 414, controlling the suction hydraulic pump 418 using the suction hydraulic control head 416, and driving at least one impeller 411 (shown in phantom) of the suction centrifugal pump 410 using the suction hydraulic motor 420 cooperating with the suction hydraulic pump 418. In various illustrative embodiments, as shown in FIG. 5, for example, the suction centrifugal pump 410 may have a plurality of impellers 411, 511 (shown in phantom).

In various illustrative embodiments, the method 600 may further comprise sensing the discharge pressure of the inlet fluid 465 mixed with the proppant 455 from the mixer 440 provided by the discharge centrifugal pump 460 using the discharge pressure sensor 462, as indicated at 475, receiving the discharge pressure information sensed by the discharge pressure sensor 462 using the discharge pressure controller 464, controlling the discharge hydraulic control head 466 using the discharge pressure controller 464, controlling the discharge hydraulic pump 468 using the discharge hydraulic control head 466, and driving at least one impeller 461 (shown in phantom) of the discharge centrifugal pump 460 using the discharge hydraulic motor 470 cooperating with the discharge hydraulic pump 468. In various illustrative embodiments, as shown in FIG. 5, for example, the discharge centrifugal pump 460 may have a plurality of impellers 461, 561 (shown in phantom).

In various illustrative embodiments, the method 600 may further comprise providing the suction pressure in a range of from about 1 pound per square inch (psi) to about 5 pounds per square inch (psi). In various exemplary illustrative embodiments, the method 600 may further comprise providing the suction pressure in a range of from about 5 pounds per square inch (psi) to about 10 pounds per square inch (psi).

In various illustrative embodiments, the method 600 may further comprise using the mixer 440 to provide an additional pressure in a range of about 1 pound per square inch (psi) to about 10 pounds per square inch (psi) above the suction pressure provided by the suction centrifugal pump 410. In various exemplary illustrative embodiments, the method 600 may further comprise using the mixer 440 to provide an additional pressure of about 5 pounds per square inch (psi) above the suction pressure provided by the suction centrifugal pump 410.

In various illustrative embodiments, the method 600 may further comprise using the mixer 440 arranged to substantially minimize a wear rate in the mixer 440. In various illustrative embodiments, the method 600 may further comprise using the mixer 440 arranged to substantially minimize vapor released from volatile liquids due to lower differential pressures. In various illustrative embodiments, the method 600 may further comprise using the mixer 440 arranged to substantially minimize power required due to being substantially optimized for mixing.

In various illustrative embodiments, the method 600 useful in stimulation blending for fluids, mixtures, and/or slurries used in well servicing operations may further comprise sensing the impeller speed of the mixer 440 using the speed sensor 442, as indicated at 435, sensing the exit pressure of the mixer 440 using the pressure sensor 442*a*, as indicated at 435*a*, receiving the impeller speed information sensed by the speed sensor 442 and the mixer exit pressure sensed by the pressure sensor 442*a* using the speed/pressure controller 444, controlling the mixer hydraulic control head 446 using the speed/pressure controller 444, controlling the mixer hydraulic pump 448 using the hydraulic control head 446, and driving at least one impeller of the mixer 440 using the mixer hydraulic motor 450 cooperating with the mixer hydraulic pump 448. In these various illustrative embodiments, the method 600 may further comprise sensing the suction pressure of the inlet fluid 415 provided by the suction centrifugal pump 410 using the suction pressure sensor 412, as indicated at 425, receiving the suction pressure information sensed by the suction pressure sensor 412 using the suction pressure controller 414, controlling the suction hydraulic control head 416 using the suction pressure controller 414, controlling the suction hydraulic pump 418 using the suction hydraulic control head 416, and driving at least one impeller of the suction centrifugal pump 410 using the suction hydraulic motor 420 cooperating with the suction hydraulic pump 418. In these various illustrative embodiments, the method 600 may further comprise sensing the discharge pressure of the inlet fluid 465 mixed with the proppant 455 from the mixer 440 provided by the discharge centrifugal pump 460 using the discharge pressure sensor 462, as indicated at 475, receiving the discharge pressure information sensed by the discharge pressure sensor 462 using the discharge pressure controller 464, controlling the discharge hydraulic control head 466 using the discharge pressure controller 464, controlling the discharge hydraulic pump 468 using the discharge hydraulic control head 466, and driving at least one impeller of the discharge centrifugal pump 460 using the discharge hydraulic motor 470 cooperating with the discharge hydraulic pump 468.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values, in the sense of Georg Cantor. Accordingly, the protection sought herein is as set forth in the claims below.

Therefore, the present invention is well adapted to attain the ends and advantages mentioned as well as those that are inherent therein. While numerous changes may be made by those skilled in the art, such changes are encompassed within the spirit of this present invention as defined by the appended claims.

What is claimed is:

1. A device comprising:

a suction centrifugal pump capable of receiving an inlet fluid and providing a suction pressure in a range of from about 1 pound per square inch to about 5 pounds per square inch and arranged to substantially minimize a geyser effect in a proppant inlet;

a mixer capable of receiving the inlet fluid provided by the suction centrifugal pump and mixing the inlet fluid with a proppant received from the proppant inlet, the mixer arranged to be substantially optimized for mixing; and a discharge centrifugal pump capable of receiving the inlet fluid mixed with the proppant from the mixer and discharging the inlet fluid mixed with the proppant from the mixer downhole, the discharge centrifugal pump arranged to be substantially optimized for pumping.

2. The device of claim 1, further comprising:

a speed sensor capable of sensing an impeller speed of the mixer;

a pressure sensor capable of sensing a mixer exit pressure;

a speed/pressure controller capable of receiving the impeller speed information sensed by the speed sensor and the mixer exit pressure information sensed by the pressure sensor;

a mixer hydraulic control head capable of being controlled by the speed/pressure controller;

a mixer hydraulic pump capable of being controlled by the hydraulic control head; and a mixer hydraulic motor capable of cooperating with the mixer hydraulic pump to drive at least one impeller of the mixer.

3. The device of claim 1, further comprising:

a suction pressure sensor capable of sensing the suction pressure of the inlet fluid provided by the suction centrifugal pump;

a suction pressure controller capable of receiving the suction pressure information sensed by the suction pressure sensor;

a suction hydraulic control head capable of being controlled by the suction pressure controller;

a suction hydraulic pump capable of being controlled by the suction hydraulic control head; and a suction hydraulic motor capable of cooperating with the suction hydraulic pump to drive at least one impeller of the suction centrifugal pump.

4. The device of claim 1, further comprising:

a discharge pressure sensor capable of sensing a discharge pressure of the inlet fluid mixed with the proppant from the mixer provided by the discharge centrifugal pump;

a discharge pressure controller capable of receiving the discharge pressure information sensed by the discharge pressure sensor;

a discharge hydraulic control head capable of being controlled by the discharge pressure controller;

a discharge hydraulic pump capable of being controlled by the discharge hydraulic control head; and a discharge hydraulic motor capable of cooperating with the discharge hydraulic pump to drive at least one impeller of the discharge centrifugal pump.

5. The device of claim 1, wherein the mixer arranged to be substantially optimized for mixing is capable of providing an additional pressure in a range of about 1 pound per square inch to about 10 pounds per square inch above the suction pressure provided by the suction centrifugal pump.

6. The device of claim 1, wherein the mixer arranged to be substantially optimized for mixing is arranged to substantially minimize a wear rate in the mixer.

7. The device of claim 1, wherein the mixer arranged to be substantially optimized for mixing is arranged to substantially minimize vapor released from volatile liquids due to lower differential pressures.

8. The device of claim 1, wherein the mixer arranged to be substantially optimized for mixing is arranged to substantially minimize power required due to being substantially optimized for mixing.

9. The device of claim 2, further comprising:

a suction pressure sensor capable of sensing the suction pressure of the inlet fluid provided by the suction centrifugal pump;

a suction pressure controller capable of receiving the suction pressure information sensed by the suction pressure sensor;

a suction hydraulic control head capable of being controlled by the suction pressure controller;

a suction hydraulic pump capable of being controlled by the suction hydraulic control head;

a suction hydraulic motor capable of cooperating with the suction hydraulic pump to drive at least one impeller of the suction centrifugal pump;

a discharge pressure sensor capable of sensing a discharge pressure of the inlet fluid mixed with the proppant from the mixer provided by the discharge centrifugal pump;

a discharge pressure controller capable of receiving the discharge pressure information sensed by the discharge pressure sensor;

a discharge hydraulic control head capable of being controlled by the discharge pressure controller;

a discharge hydraulic pump capable of being controlled by the discharge hydraulic control head; and a discharge hydraulic motor capable of cooperating with the discharge hydraulic pump to drive at least one impeller of the discharge centrifugal pump, wherein the mixer arranged to be substantially optimized for mixing is arranged to substantially minimize a wear rate in the mixer, to substantially minimize vapor released from volatile liquids due to lower differential pressures, and to substantially minimize power required due to being substantially optimized for mixing.

10. A method comprising:

providing a suction pressure in a range of from about 1 pound per square inch to about 5 pounds per square inch and arranged to substantially minimize a geyser effect in a proppant inlet using a suction centrifugal pump receiving an inlet fluid;

receiving the inlet fluid provided by the suction centrifugal pump and mixing the inlet fluid with a proppant received from the proppant inlet using a mixer arranged to be substantially optimized for mixing; and receiving the inlet fluid mixed with the proppant from the mixer and discharging the inlet fluid mixed with the proppant from the mixer downhole using a discharge centrifugal pump arranged to be substantially optimized for pumping.

11. The method of claim 10, further comprising:

sensing an impeller speed of the mixer using a speed sensor;

sensing a mixer exit pressure using a pressure sensor;

receiving the impeller speed information sensed by the speed sensor and the mixer exit pressure information sensed by the pressure sensor using a speech/pressure controller;

controlling a mixer hydraulic control head using the speed/pressure controller;

controlling a mixer hydraulic pump using the hydraulic control head; and driving at least one impeller of the mixer using a mixer hydraulic motor cooperating with the mixer hydraulic pump.

12. The method of claim 10, further comprising:

sensing the suction pressure of the inlet fluid provided by the suction centrifugal pump using a suction pressure sensor;

receiving the suction pressure information sensed by the suction pressure sensor using a suction pressure controller;

controlling a suction hydraulic control head using the suction pressure controller;

controlling a suction hydraulic pump using the suction hydraulic control head; and driving at least one impeller of the suction centrifugal pump using a suction hydraulic motor cooperating with the suction hydraulic pump.

13. The method of claim 10, further comprising:

sensing a discharge pressure of the inlet fluid mixed with the proppant from the mixer provided by the discharge centrifugal pump using a discharge pressure sensor;

receiving the discharge pressure information sensed by the discharge pressure sensor using a discharge pressure controller;

controlling a discharge hydraulic control head using the discharge pressure controller;

controlling a discharge hydraulic pump using the discharge hydraulic control head; and driving at least one impeller of the discharge centrifugal pump using a discharge hydraulic motor cooperating with the discharge hydraulic pump.

14. The method of claim 10, wherein receiving the inlet fluid provided by the suction centrifugal pump and mixing the inlet fluid with the proppant received from the proppant inlet using the mixer arranged to be substantially optimized for mixing further comprises using the mixer to provide an additional pressure in a range of about 1 pound per square inch to about 10 pounds per square inch above the suction pressure provided by the suction centrifugal pump.

15. The method of claim 10, wherein the mixer arranged to be substantially optimized for mixing is arranged to substantially minimize a wear rate in the mixer.

16. The method of claim 10, wherein the mixer arranged to be substantially optimized for mixing is arranged to substantially minimize vapor released from volatile liquids due to lower differential pressures.

17. The method of claim 10, wherein the mixer arranged to be substantially optimized for mixing is arranged to substantially minimize power required due to being substantially optimized for mixing.

18. The method of claim 11, further comprising:

sensing the suction pressure of the inlet fluid provided by the suction centrifugal pump using a suction pressure sensor;

receiving the suction pressure information sensed by the suction pressure sensor using a suction pressure controller;

controlling a suction hydraulic control head using the suction pressure controller;

controlling a suction hydraulic pump using the suction hydraulic control head;

driving at least one impeller of the suction centrifugal pump using a suction hydraulic motor cooperating with the suction hydraulic pump;

sensing a discharge pressure of the inlet fluid mixed with the proppant from the mixer provided by the discharge centrifugal pump using a discharge pressure sensor;

receiving the discharge pressure information sensed by the discharge pressure sensor using a discharge pressure controller;

controlling a discharge hydraulic control head using the discharge pressure controller;

controlling a discharge hydraulic pump using the discharge hydraulic control head; and driving at least one impeller of the discharge centrifugal pump using a discharge hydraulic motor cooperating with the discharge hydraulic pump, wherein the mixer arranged to be substantially optimized for mixing is arranged to substantially minimize a wear rate in the mixer, to substantially minimize vapor released from volatile liquids due to lower differential pressures, and to substantially minimize power required due to being substantially optimized for mixing.

19. A system useful in stimulation blending for at least one of fluids, mixtures, and slurries used in well servicing operations, the system comprising:

a suction centrifugal pump capable of receiving an inlet fluid and providing a suction pressure arranged to substantially minimize a geyser effect in a proppant inlet;

a mixer capable of receiving the inlet fluid provided by the suction centrifugal pump and mixing the inlet fluid with a proppant received from the proppant inlet, the mixer arranged to be substantially optimized for mixing;

a discharge centrifugal pump capable of receiving the inlet fluid mixed with the proppant from the mixer and discharging the inlet fluid mixed with the proppant from the mixer downhole, the discharge centrifugal pump arranged to be substantially optimized for pumping; and at least one downhole pump capable of receiving the inlet fluid mixed with the proppant from the mixer discharged downhole by the discharge centrifugal pump.

20. The system of claim 19, further comprising:

a speed sensor capable of sensing an impeller speed of the mixer;

a pressure sensor capable of sensing a mixer exit pressure;

a speed/pressure controller capable of receiving the impeller speed information sensed by the speed sensor and the mixer exit pressure information sensed by the pressure sensor;

a mixer hydraulic control head capable of being controlled by the speed/pressure controller;

a mixer hydraulic pump capable of being controlled by the hydraulic control head; and a mixer hydraulic motor capable of cooperating with the mixer hydraulic pump to drive at least one impeller of the mixer.

21. The system of claim 19, further comprising:

a suction pressure sensor capable of sensing the suction pressure of the inlet fluid provided by the suction centrifugal pump;

a suction pressure controller capable of receiving the suction pressure information sensed by the suction pressure sensor;

a suction hydraulic control head capable of being controlled by the suction pressure controller;

a suction hydraulic pump capable of being controlled by the suction hydraulic control head; and a suction hydraulic motor capable of cooperating with the suction hydraulic pump to drive at least one impeller of the suction centrifugal pump.

22. The system of claim 19, further comprising:

a discharge pressure sensor capable of sensing a discharge pressure of the inlet fluid mixed with the proppant from the mixer provided by the discharge centrifugal pump;

a discharge pressure controller capable of receiving the discharge pressure information sensed by the discharge pressure sensor;

a discharge hydraulic control head capable of being controlled by the discharge pressure controller;

a discharge hydraulic pump capable of being controlled by the discharge hydraulic control head; and a discharge hydraulic motor capable of cooperating with the discharge hydraulic pump to drive at least one impeller of the discharge centrifugal pump.

23. The system of claim 19, wherein the suction centrifugal pump capable of receiving the inlet fluid and providing the suction pressure arranged to substantially minimize the geyser effect in the proppant inlet is capable of providing the suction pressure in a range of from about 1 pound per square inch to about 5 pounds per square inch.

24. The system of claim 19, wherein the mixer arranged to be substantially optimized for mixing is capable of providing an additional pressure in a range of about 1 pound per square inch to about 10 pounds per square inch above the suction pressure provided by the suction centrifugal pump.

25. The system of claim 19, wherein the mixer arranged to be substantially optimized for mixing is arranged to substantially minimize a wear rate in the mixer.

26. The system of claim 19, wherein the mixer arranged to be substantially optimized for mixing is arranged to substantially minimize vapor released from volatile liquids due to lower differential pressures.

27. The system of claim 19, wherein the mixer arranged to be substantially optimized for mixing is arranged to substantially minimize power required due to being substantially optimized for mixing.

28. The system of claim 20, further comprising:

a suction pressure sensor capable of sensing the suction pressure of the inlet fluid provided by the suction centrifugal pump;

a suction pressure controller capable of receiving the suction pressure information sensed by the suction pressure sensor;

a suction hydraulic control head capable of being controlled by the suction pressure controller;

a suction hydraulic pump capable of being controlled by the suction hydraulic control head;

a suction hydraulic motor capable of cooperating with the suction hydraulic pump to drive at least one impeller of the suction centrifugal pump;

a discharge pressure sensor capable of sensing a discharge pressure of the inlet fluid mixed with the proppant from the mixer provided by the discharge centrifugal pump;

a discharge pressure controller capable of receiving the discharge pressure information sensed by the discharge pressure sensor;

a discharge hydraulic control head capable of being controlled by the discharge pressure controller;

a discharge hydraulic pump capable of being controlled by the discharge hydraulic control head; and a discharge hydraulic motor capable of cooperating with the discharge hydraulic pump to drive at least one impeller of the discharge centrifugal pump, wherein the mixer arranged to be substantially optimized for mixing is arranged to substantially minimize a wear rate in the mixer, to substantially minimize vapor released from volatile liquids due to lower differential pressures, and to substantially minimize power required due to being substantially optimized for mixing.

* * * * *